US006491423B1

(12) United States Patent
Skibo et al.

(10) Patent No.: US 6,491,423 B1
(45) **Date of Patent: *Dec. 10, 2002**

(54) APPARATUS FOR MIXING PARTICLES INTO A LIQUID MEDIUM

(75) Inventors: Michael D. Skibo, Leucadia; David M. Schuster, La Jolla, both of CA (US)

(73) Assignee: MC21, Incorporated, San Diego, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/041,477

(22) Filed: Mar. 11, 1998

(51) Int. Cl.[7] ..... B01F 5/26

(52) U.S. Cl. ..... 366/146; 366/169.1; 366/175.2; 366/306; 366/317; 266/235

(58) Field of Search ..... 366/302, 303, 366/306, 168.1, 169.1, 175.2, 175.1, 139, 144, 170.4, 305, 304, 176.1–176.4, 146, 317; 75/708; 266/235, 233

(56) References Cited

U.S. PATENT DOCUMENTS

| | | | | |
|---|---|---|---|---|
| 1,762,950 A | * | 6/1930 | Beers | 266/216 |
| 2,890,039 A | * | 6/1959 | Schmidt | 266/216 |
| 3,728,108 A | | 4/1973 | Sifferlen et al. | |
| 3,858,640 A | | 1/1975 | Sifferlen | 164/250 |
| 4,002,326 A | * | 1/1977 | Brogli et al. | |
| 4,313,909 A | * | 2/1982 | Boden et al. | |
| 4,557,605 A | | 12/1985 | Kenney et al. | 366/134 |
| 4,618,427 A | | 10/1986 | Venas | 210/629 |
| 4,759,995 A | | 7/1988 | Skibo et al. | 428/614 |
| 4,786,467 A | | 11/1988 | Skibo et al. | 420/129 |
| 4,865,806 A | | 9/1989 | Skibo et al. | 420/129 |
| 4,865,808 A | | 9/1989 | Ichikawa et al. | 428/548 |

(List continued on next page.)

FOREIGN PATENT DOCUMENTS

| | | |
|---|---|---|
| JP | 143456 | 9/1982 |

OTHER PUBLICATIONS

R. Asthana, "Cast Metal–Matrix Composites. I:Fabrication Techniques," Journal of Materials Synthesis and Processing vol. 5(4): pp. 251–278 (1997).

(List continued on next page.)

*Primary Examiner*—Charles E. Cooley
*Assistant Examiner*—David Sorkin
(74) *Attorney, Agent, or Firm*—Wagner, Murabito & Hao LLP

(57) ABSTRACT

An apparatus for mixing particles in a liquid or semi-liquid medium, such as ceramic reinforcing particles in a molten metal or metal alloy matrix for the production of stir-cast metal matrix composite (MMC) materials. The particles can be introduced under the surface of the matrix by feeding the particles through the inner passage of a rotatable hollow impeller tube. The impeller tube is terminated at its lower end by an impeller head that includes teeth positioned proximate to an impeller base. The particles enter the matrix through a shear region in and around the volume between the impeller base and the impeller head. The rotating impeller and the high shear force thereby created wet the particles in the composite matrix and effect homogenization of the composite matrix. The present invention may be practiced either under vacuum or atmospheric pressure.

5 Claims, 5 Drawing Sheets

U.S. PATENT DOCUMENTS

| | | | | | |
|---|---|---|---|---|---|
| 4,901,780 | A | | 2/1990 | Sasaki et al. | 164/4.1 |
| 4,943,413 | A | | 7/1990 | Tank | 420/528 |
| 4,961,461 | A | | 10/1990 | Klier et al. | 164/461 |
| 5,025,849 | A | | 6/1991 | Karmarkar et al. | 164/97 |
| 5,083,602 | A | | 1/1992 | Skibo | 164/97 |
| 5,167,920 | A | | 12/1992 | Skibo et al. | 420/548 |
| 5,186,234 | A | | 2/1993 | Hammond et al. | 164/97 |
| 5,394,928 | A | | 3/1995 | Hammond et al. | 164/97 |
| 5,402,843 | A | | 4/1995 | Skibo | 164/97 |
| 5,413,315 | A | * | 5/1995 | Venas et al. | 266/222 |
| 5,462,581 | A | * | 10/1995 | Eckert | 75/678 |
| 5,531,425 | A | | 7/1996 | Skibo et al. | 266/208 |
| 5,772,725 | A | * | 6/1998 | Eckert | 75/10.18 |
| 5,779,360 | A | * | 7/1998 | Tanaka | 366/286 |
| 6,264,357 | B1 | * | 7/2001 | Kamiyama et al. | |

OTHER PUBLICATIONS

R. Asthana, "Cast Metal–Matrix Composites. II: Process Fundamentals," Journal of Materials Synthesis and Processing vol. 5(5): pp. 339–361 (1997).

R. Asthana, "Review: Reinforced Cast Metals, Part I Solidification Microstructure," Journal of Materials Science vol. 33: pp. 1679–1698 (1998).

R. Asthana, "Review: Reinforced Cast Metals, Part II Evolution of the Interface," Journal of Materials Science vol. 33: pp. 1959–1980 (1998).

A. Luo, "Processing, Microstructure, and Mechanical Behavior of Cast Magnesium Metal Matrix Composites," Metallurgical and Materials Transactions A vol. 26A: pp. 2445–2455 (1995).

S. Ray, "Review: Synthesis of Cast Metal Matrix Particulate Composites," Journal of Materials Science vol. 28: pp. 5397–5413 (1993).

S. Ray, "Casting of Metal Matrix Composites," Key Engineering Materials vols. 104–107: pp. 417–446 (1995).

M. Gupta et al., "Processing–Microstructure–Mechanical Properties of A1 Based Metal Matrix Composites Synthesized Using Casting Route," Key Engineering Materials vols. 104–107: pp. 259–274 (1995).

K. Xiao et al., "On the Distribution of Particulates in Cast Metal Matrix Composites," Journal of Reinforced Plastics and Composites vol. 15: pp. 1131–1148 (1996).

V. Kevorkijan, "An Ideal Reinforcement for Structural Composites," American Ceramic Society Bulletin: pp. 61–67 (1997).

P. Rohatgi, "Future Directions in Solidification of Metal Matrix Composites," Key Engineering Materials vols. 104–107: pp. 293–312 (1995).

P. Rohatgi et al., "Cast Aluminum Alloy—Fly Ash Composites," Key Engineering Materials vols. 104–107: pp. 283–292 (1995).

K. Sukamaran et al., "The Effects of Magnesium Additions on the Structure and Properties of A1–7 Si–10 $SiC_p$ Composites," Journal of Materials Science vol. 30: pp. 1469–1472 (1995).

Y. Chen et al., "*In Situ* A1–TiB Composite Obtained by Stir Casting," Journal of Materials Science vol. 31: pp. 311–315 (1996).

K. Yamada et al., "The Optimum Condition of Compocasting Method for the Particle Reinforced MMC," 34th International SAMPE Symposium: pp. 2266–2277 (1989).

R. Mehrabian et al., "Preparation and Casting of Metal–Particulate Non–Metal Composites," Metallurgical Transactions vol. 5: pp. 1899–1905 (1974).

A. Sato et al., "Aluminum Matrix Composites: Fabrication and Properties," Metallurgical Transactions B vol. 7B: pp. 443–451 (1976).

B. F. Quigley et al., "A Method for Fabrication of Aluminum–Alumina Composites," Metallurgical Transactions A vol. 13A: pp. 93–100 (1982).

A. Mortensen et al., "The Status of Metal–Matrix Composite Research and Development in Japan," Journal of Metals: pp. 10–18 (1993).

M. K. Surappa et al., "Preparation and Properties of Cast Aluminum–Ceramic Particle Composites," Journal of Materials Science vol. 16: pp. 983–993 (1981).

M. Kobashi et al., "Effects of Alloying Elements on SiC Dispersion in Liquid Aluminum," Materials Transactions, JIM vol. 31: pp. 1101–1107 (1990).

H. Moon et al., "Rheological Behavior of SiC Particulate–(Al–6.5wt.%Si) Composite Slurries at Temperatures Above the Liquidus and Within the Liquid+Solid Region of the Matrix," Materials Science and Engineering vol. A144: pp. 253–265 (1991).

P. Rohatgi et al., "Friction and Abrasion Resistance of Cast Aluminum Alloy–Fly Ash Composites," Metallurgical and Materials Transactions A vol. 28A: pp. 245–250 (1997).

P. Rohatgi et al., "Low Cost Aluminum–Fly Ash Composites for Ultralight Automotive Application," in *Automotive Alloys*: pp. 157–169 (1997).

R. Guo et al., "Casting Characteristics of Aluminum Alloy, Fly Ash Composites," AFS Transactions vol. 166: pp. 1097–1101 (1996).

A. Mortensen et al., "Solidification Processing of Metal Matrix Composites," International Materials Reviews vol. 37: pp. 101–128 (1992).

C. May, "An Economical, Net Shape Process for Metal Matrix Composites," Technical Paper presented at Society of Manufacturing Engineers, Metal Matrix Clinic: (1990).

C. Vives, "Elaboration of Metal Matrix Composites from Thixotropic Alloy Slurries Using a New Magnetohydrodynamic Caster," Metallurgical Transactions B vol. 24B: pp. 493–510 (1993).

O. Ilegbusi et al., "Mathematical Modeling of the Electromagnetic Stirring of Molten Metal–Solid Suspensions," Transactions ISIJ vol. 28: pp. 97–103 (1988).

A. Mortensen et al., "Solidification Processing of Metal–Matrix Composites," Journal of Metals vol. 40: pp. 12–19 (1988).

P. Rohatgi et al., "Solidification, Structures, and Properties of Cast Metal–Ceramic Particle Composities," International Metals Reviews vol. 31: pp. 115–139 (1986).

J. Cornie et al., "A Review of Semi–Solid Slurry Processing of A1 Matrix Composites," Proceedings of an ASM International Conference on Fabrication of Particulates Reinforced Metal Composities: pp. 63–78 (1990).

* cited by examiner

APPARATUS FOR MIXING PARTICLES INTO A LIQUID MEDIUM

FIELD OF THE INVENTION

This invention relates generally to particle mixing technology and, more particularly, to an apparatus and method for mixing particles into a liquid or semi-liquid medium. In certain preferred embodiments, the invention relates to the mixing of nonmetallic reinforcing particles into molten metals or metal alloys for the production of stir-cast metal matrix composite (MMC) materials.

BACKGROUND OF THE INVENTION

Metal matrix composites (MMCs), particularly those based upon aluminum alloys, have gained increasing popularity and recognition as alternative structural materials, especially for applications requiring increased stiffness, wear resistance, and strength. MMCs are usually produced by mixing nonmetallic reinforcing particles such as grit, powder, fibers or the like into a metallic matrix. For example, aluminum-based MMCs are composed typically of aluminum alloys (e.g., 6061, 2024, 7075, or A356) reinforced with ceramic particles such as silicon carbide or aluminum oxide (alumina) powder. The reinforcement provided by these particles contributes strength, stiffness, hardness, and wear resistance, in addition to other desirable properties, to the composite.

Despite their growing market, the high cost of manufacturing MMCs has hampered their ability to be priced competitively with unreinforced metallic materials. Traditionally, the fabrication of metal matrix composites has employed non-liquid methods such as the compaction of blends of ceramic particles or fibers and aluminum powders, or the metal spraying of continuous fibers in a lay-up process. Unfortunately, the high cost of metallic powders and the explosion and pyrophoric hazards associated with large quantities of powders have prevented a significant reduction in the cost of MMCs produced by this approach.

In addition, the use of liquid metals in MMC fabrication has largely been limited to the infiltration of ceramic preforms. The mixing of ceramic particles into molten aluminum using stir-cast methods has not been advantageous due to problems with the incomplete wetting of fine particles having a large surface area, as well as the rapid oxidation of a chemically reactive molten metal (e.g., aluminum) during agitation. On the other hand, the simplicity of this approach and its potential for producing low cost MMCs has led to numerous studies on the fabrication of aluminum-based MMCs through stir-casting. Numerous researchers have reported experiments involving the mixing of various ceramic, powders and fibers into molten aluminum-based matrices. The equipment and methods utilized in many of these experiments were extremely simple. The equipment usually consisted of a heated crucible containing molten aluminum alloy and a motor to rotate a paddle-style impeller made of graphite or coated steel in the molten aluminum while ceramic particles were added to the surface of the molten metal (i.e., the melt). The vortex formed by the rotating impeller drew the ceramic particles into the melt and the shear developed between the impeller and the walls of the crucible helped wet the particles. The temperature was usually maintained below the liquidus temperature (in the two-phase region) to keep the aluminum alloy in a semi-solid condition, since the higher viscosity of the partially solid melt further increased the shear force created by the simple impeller. This process has been called compocasting.

The aluminum-based MMCs made by compocasting suffered from various problems. In particular, since the process was carried out under atmospheric pressure, the vortex formed by the impeller rotation drew considerable amounts of gas into the melt. Also, because the composite is sensitive to turbulence and the particles act as sites for the entrapment of gas bubbles, the solidified composites produced by compocasting were often porous. In addition, it was common for these compocast MMCs to contain numerous oxide skins due to the passing of the particles through the surface oxide into the body of the melt. Another problem with the compocasting process is the low level of shear developed by the rotating impeller in the semi-liquid matrix. Since shear is needed for wetting, the particles are generally incompletely wetted by the molten metal alloys. In sum, the quality of the composites produced by these stir-cast approaches was poor and not considered commercially viable.

The aforementioned compocasting process and other prior processing techniques used in the manufacture of metal matrix composite materials are described in detail in U.S. Pat. No. 5,531,425 to Skibo et al., the disclosure of which is incorporated herein by reference.

Today, Duralcan, a division of Alcan Aluminum Corporation, is a leader in the manufacture and sale of stir-cast aluminum-based MMCs. The technological development which led to the Duralcan process is based on an improvement in mixing efficiency combined with a reduction in gas entrapment. In this process, a low vacuum of approximately 1–5 torr is drawn over molten aluminum heated above the liquidus temperature (in the fully liquid region). The reinforcing particles are added to the surface of the melt and an impeller capable of creating a moderately high level of shear in a low viscosity melt is inserted into the molten metal and stirred at high rotational speed, as measured in revolutions per minute (rpm). The vacuum removes the air which tends to act as a buffer, cushioning the particles and preventing intimate contact with the metal. With the particles in contact with the metal from the start of the process, wetting can begin immediately. The high shear impeller physically shears the particles into the aluminum alloy, spreading the aluminum over the high surface area of the fine particles, thereby rapidly wetting them. The quality of the resulting MMC is much improved over that produced by the other techniques described above. The particles are essentially 100% wetted and there is little or no porosity in the Duralcan MMC. However, while the end product of the Duralcan process is of high quality, the high cost of manufacture, due in large part to the inefficiency of particle mixing and wetting, prevents Duralcan from fully exploiting the potential MMC market.

The Duralcan process is a batch process that can be divided into three general stages. The first stage is the incorporation of the particles into the molten aluminum, i.e., bringing the particles into intimate contact with the aluminum so that wetting can begin. This stage relies on the formation of a vortex to draw the particles into the body of the melt and a vacuum for eliminating the cushioning effect of gas at atmospheric pressure. In the second stage, the particles must be sheared into the melt through the use of a rotating impeller which produces high shear force. In general, the impeller must have sharp teeth and rotate at sufficient rotational speed in order to break up agglomerates of particles such that each particle may individually come into contact with the aluminum melt. The rotational speed requirement seems to be related to a minimum level of shear generated at a specific surface velocity of the impeller in the melt. Typically, if the rotational speed of the impeller, as measured in rpm, is too low and/or the edges of the teeth are dull, low porosity MMC material comprising well-wetted particles cannot be produced. To further enhance the level of shear, a stationary bar or baffle is positioned proximate to the perimeter of the rotating impeller. A small region of increased shear is created between the outer periphery of the impeller and the baffle. The third stage involves the slow general motion of the composite in the mixing vessel so that substantially all of the composite eventually passes through the region of high shear several times. This motion also ensures uniformity of particle distribution throughout the batch.

However, the Duralcan process, and other similar stir-cast processes practiced presently, have certain shortcomings and disadvantages. In particular, the wetting of the particles, which is the main objective of mixing, begins only when the ceramic particles that are poured on the surface of the molten metal move downward through the matrix towards the rotating impeller. This process proceeds at a slow rate because the vortex is comparatively small and the downward motion is not especially strong; also, localized shear is provided only in the proximity of the baffle. Furthermore, because the ceramic particles are added to the matrix surface, the particle feed rate must be carefully controlled so as to prevent the accumulation of particles on the surface which can, in turn, choke the agitator and further slow the mixing process. Although the impeller and baffle system is simple, rugged, and easy to repair, it is inefficient and does not take advantage of the potential region of high shear which could be made to completely surround the rotating impeller. As a result, the wetting process takes much longer than necessary because the particles must pass through the narrow shear region between the impeller and the baffle several times before the agglomerates are dispersed and the molten aluminum uniformly contacts and wets each particle.

The inefficient mixing of large quantities of MMCs also produces defects in the molten composite. More specifically, agglomerates of incompletely wetted particles may become encased in heavy stable oxide skins which form as the particles roll on the melt surface oxide before submerging and moving towards the impeller. If the oxide coating is thick, the mixing process will sometimes have insufficient intensity to break the agglomerates into individually wetted particles regardless of mixing duration. These partially wetted agglomerates persist after mixing and can lead to internal and surface defects which may be detrimental to properties such as fatigue and fracture. The aluminum oxide skins also have a detrimental effect on the MMC product, because they increase the viscosity of the composite matrix during the casting process and limit the ability to cast intricate shapes having thin walls.

Prior attempts at increasing the rate of particle wetting and decreasing the process time for particle mixing have not been wholly successful. For example, Sifferlin, in U.S. Pat. No. 3,858,640, describes the introduction of reinforcing particles into molten metal by blowing the particles into the melt using an inert gas. The large amounts. of gas required to carry the particulate would immediately become entrapped in the composite matrix, which is extremely sensitive to gas and turbulence, and would result in a porous composite product. Others have described a process in which the particles are plunged under the surface of the composite matrix during mixing with a mechanical hand cylinder. This process, however, produces MMCs with numerous oxide skins since the particles are pushed down through the surface oxide into the body of the matrix.

Many of the aforementioned concerns and shortcomings relating to the prior technology for MMC stir-cast mixing also exist for particle mixing generally, especially where high shear is required to effectively mix the particles into a matrix (e.g., where the particles are not readily wetted by the matrix). Thus, there exists generally a need for an efficient apparatus and method for rapidly mixing particles into a liquid or semi-liquid matrix, particularly particles that tend to agglomerate or that are difficult to wet by the matrix, and which therefore require high shear force. More specifically, there is a continuing need for a mixing method and apparatus for producing stir-cast metal matrix composite materials which rapidly and thoroughly mix particles into a matrix comprising a molten metal, thereby reducing MMC processing costs, while avoiding common problems such as incomplete particle wetting, entrapment of gases, oxidation, and non-uniform particle distribution. The present invention fulfills these needs, and further provides related advantages.

SUMMARY OF THE INVENTION

The present invention obviates the foregoing problems and provides generally a method and apparatus for mixing particles into a liquid or semi-liquid medium and provides, more specifically, a method and apparatus for mixing non-metallic reinforcing particles into a molten metal or metal alloy for the production of metal matrix composite (MMC) materials. The apparatus and process of this invention permit rapid mixing of particles into an MMC matrix, thereby reducing process times and, consequently, manufacturing costs. As a result, the cost of preparing MMC materials can be significantly reduced, such that MMCs can be priced competitively with unreinforced metals and metal alloys.

According to the present invention, a method and apparatus for mixing particles into a medium having a liquid or semi-liquid state are provided. In accordance with a preferred embodiment of the present invention, a method and apparatus for mixing particles into a molten metal or metal alloy for the production of stir-cast metal matrix composite materials are provided. This production process is made more efficient than prior art processes by increasing both the rate of wetting and the speed at which the particles can be added to the melt. In this process, mixing (and wetting) of the particles is improved by increasing the level of shear, as well as the size and location of the shear region. In part, the increase in shear is accomplished by increasing the rotational speed of the impeller. In addition, the shear region is positioned at the very location at which the particles are introduced into the matrix, thereby decreasing the time required for the particles to reach the shear region and significantly increasing the fraction of particles which pass through the shear region. Moreover, the particles are introduced into the matrix under the matrix surface, thereby avoiding the introduction of oxide skins into the MMC.

The present invention includes an impeller useful for mixing particles into a liquid medium contained in a vessel, which optionally may be heated or cooled. The impeller preferably comprises a hollow impeller tube having an inner passage into which particles may be directed. The particles may then be directed through the inner passage and into the body of the matrix through an open end of the impeller tube at an introduction point below the surface of the matrix. The impeller tube may further include an impeller head that preferably projects radially outward from the impeller tube. It is particularly preferred that the impeller head is positioned in close proximity to an impeller base, which preferably has contours that are generally complementary to the impeller head. It is preferred that the impeller base is similar in size and shape to the impeller head so that a region of high shear exists in the volume generally between and around the impeller base and the impeller head. The impeller head preferably has one or more teeth to provide the impact forces which aid in breaking up and dispersing particle agglomerates and to entrain a larger amount of the matrix during rotation of the impeller.

It will now be apparent from the foregoing that the method and apparatus of the present invention present a significant advance generally in the field of particle mixing and, more particularly, in the field of manufacturing metal matrix composite materials. In particular, the present invention avoids or minimizes many of the shortcomings of the prior art, while significantly decreasing the process time and cost of MMC manufacture. Other features and advantages of the present invention will become apparent from the following detailed description, as well as the accompanying drawings which illustrate, by way of example, certain principles of various preferred embodiments of the invention.

DETAILED DESCRIPTION OF PREFERRED EMBODIMENTS

The present invention provides in certain embodiments an apparatus and method for more efficiently producing stir-cast metal matrix composites. This process addresses the major problems or disadvantages of the existing stir-cast technology, including a reduction in mixing time through increased mixing efficiency, increased shear at the impeller, and an improved and faster method of feeding the particles into the matrix. As a result, MMC quality can also be improved. In addition, in one embodiment, this invention offers the possibility of eliminating the need for vacuum which, in turn, would significantly reduce the cost of MMC manufacture.

Figure 1A:
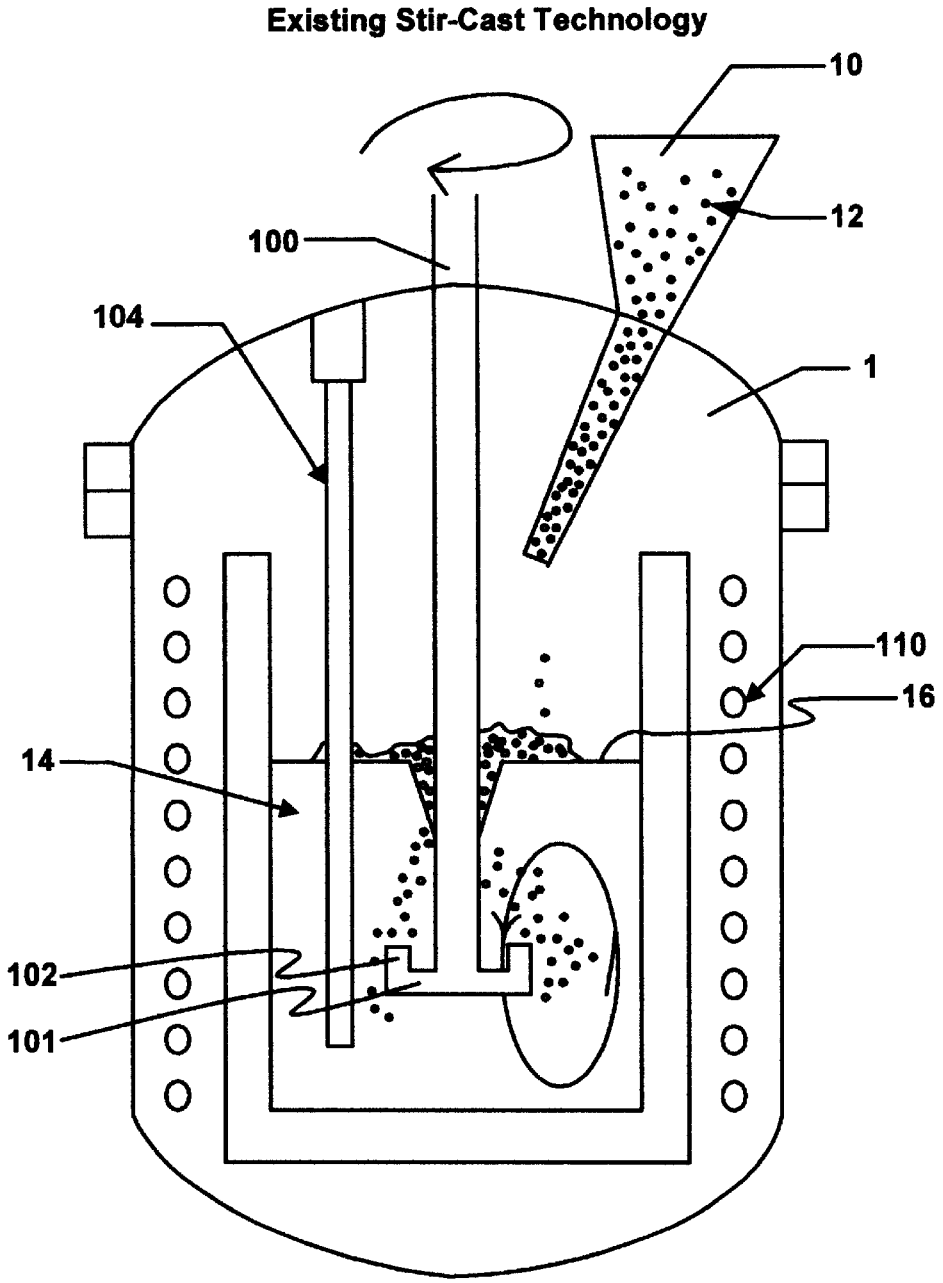
FIG. 1*a* is a schematic side sectional view of a conventional stir-cast mixing apparatus.
Figure 1B:
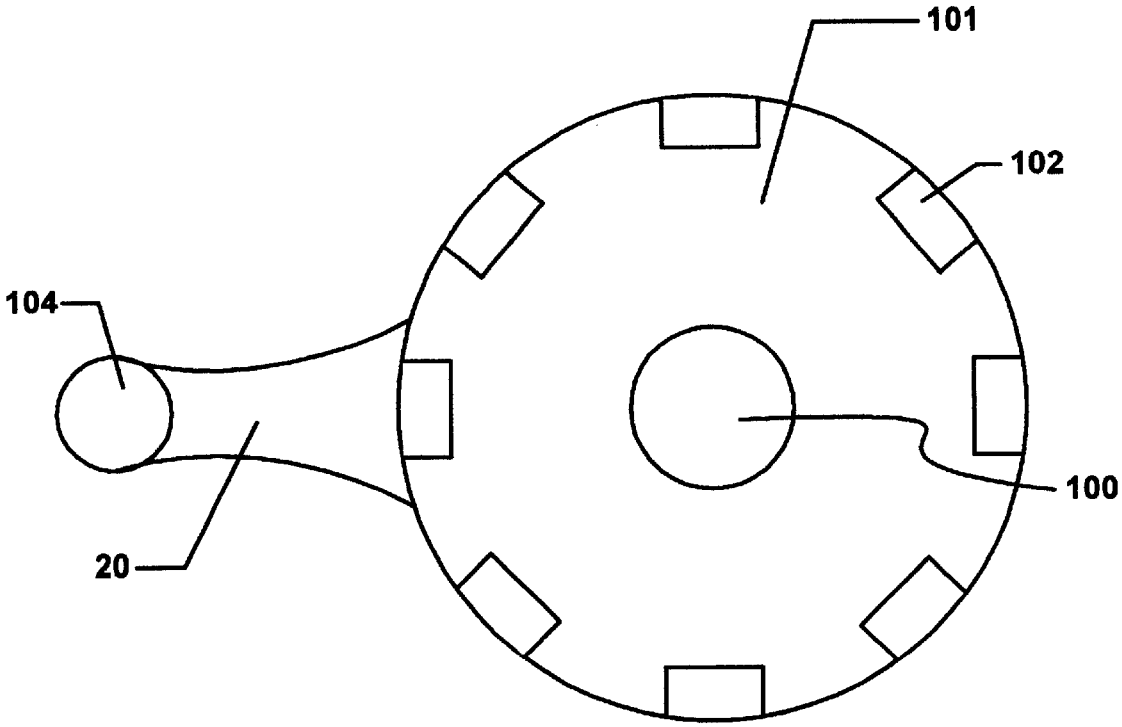
FIG. 1*b* is a top view of the impeller shaft and baffle of FIG. 1*a;*

Referring now to the drawings, there is shown in FIG. 1*a* a schematic side sectional view of a conventional stir-cast mixing apparatus, such as that: used in the Duralcan process discussed above. In that process, an aluminum alloy is. melted and degassed in a vacuum induction furnace, comprising a vacuum vessel 1 which contains a matrix 14 and which is heated to a temperature above the liquidus temperature of the alloy, and induction coils 110 which are circumferentially located in the vacuum vessel 1 and which surround the matrix 14. Referring again to FIG. 1*a,* an impeller shaft 100, comprising at its lower end a toothed ring 101 having a plurality of upwardly directed ring teeth 102, is inserted into the matrix 14 and the vacuum vessel 1 is sealed. The impeller shaft 100 and the toothed ring 101 are made of graphite, and the ring teeth 102 comprise ceramic blocks made of silicon carbide or silicon nitride, which are bonded to the graphite ring 101 to yield longer operational life under the abrasive conditions involved in stir-casting of ceramic particles in a composite matrix. A single bar-shaped baffle 104, also made of graphite, is located adjacent to and in proximity to the toothed ring 101. The baffle 104 is kept stationary during the mixing process. The proximity of the baffle 104 to the rotating toothed ring 101 during mixing provides a shear region 20 in the volume between the baffle 104 and the toothed ring 101, as illustrated in FIG. 1*b.*

Once the vacuum vessel 1 is sealed, the vessel 1 is evacuated by use of a pump or the like (not shown) to a pressure of about 1–5 torr. The actual vacuum level is not critical; however, it is preferred that the pressure remain above about 0.1–1 torr to minimize the extraction of any volatile constituents of the alloy (e.g., magnesium) from the matrix by evaporation. One skilled in the art would be familiar with the type of pump and pressure control device (if necessary) which are appropriate for reducing the pressure in the vacuum vessel 1 to the desired level. Once such vacuum level has been achieved, the vessel 1 containing the induction coils 110 is switched to the mixing cycle, causing movement of the molten alloy up the walls of the vessel 1 and down the center of the matrix 14, as illustrated by the vertical ellipse with counter-clockwise pointing arrows in FIG. 1*a.* In principle, this action helps bring the alloy into the vicinity of the centrally-located impeller shaft 100 and to homogenize the overall matrix 14. In reality, the induction mixing force in a large vessel, such as that used in the Duralcan process, is weak and most of the overall agitation of the matrix is provided by the rotating impeller.

The next step in the Duralcan process is to begin rotation of the impeller. The impeller used in the Duralcan process is so heavy that it requires approximately five minutes to come to its operational speed of 400 to 500 rpm. At that time, ceramic particles 12, typically made of silicon carbide or aluminum oxide (depending on the composite system) are added to the matrix surface 16 from an evacuated particle container 10. The particles 12 pass through a rotating gate valve (not shown) and fall under gravity onto the matrix surface 16. A mass of particles builds up on the matrix surface 16 around the impeller shaft 100 and is slowly drawn beneath the matrix surface 16 into the body of the matrix 14. The particle feed rate must be adjusted to prevent a mass of particles from covering the entire surface and choking the mixing action, further slowing the entry of particles. Moreover, due to self-agglomeration forces, the particles 12 are drawn into the matrix 14 as small clumps or agglomerates, which must first be broken down before they can be wetted by the alloy. In addition, although the molten alloy is under vacuum, there is an oxide layer on the matrix surface 16. As a result, particles 12 added to the matrix surface 16 carry oxide skins down with them as they are drawn into the body of the matrix 14. These oxide skins, composed of aluminum oxide, surround the particles and can inhibit the ability of the matrix to wet the particles and can lead to prolonged mixing times.

Once the particle agglomerates are finally pulled beneath the matrix surface 16, they approach the rotating impeller shaft 100 and toothed ring 101 and, eventually, enter the shear region 20 (see FIG. 1*b*) which exists in and around the volume between the rotating toothed ring 101 and the stationary baffle 104. In this manner, the particle agglomerates are broken down and the individual particles become wetted. However, because the particles 12 must be drawn down into the body of the matrix 14 from the matrix surface 16, they must travel a considerable distance before reaching the shear region 20, thereby prolonging the mixing and wetting processing time. Also, because of the small shear region volume in this process, it is likely that numerous passes through the shear region 20 are required to completely wet the particles 12. To illustrate, in the fabrication of a 14,000 lb. batch of MMC material using an apparatus such as that illustrated in FIG. 1*a,* up to approximately 60–75 minutes are required to add the ceramic particles to the matrix surface 16, followed by up to about 60 minutes of mixing to complete the wetting. At this point, the vessel 1 is vented to the atmosphere and then the composite is cast into extrusion billet or foundry ingot.

Figure 2A:
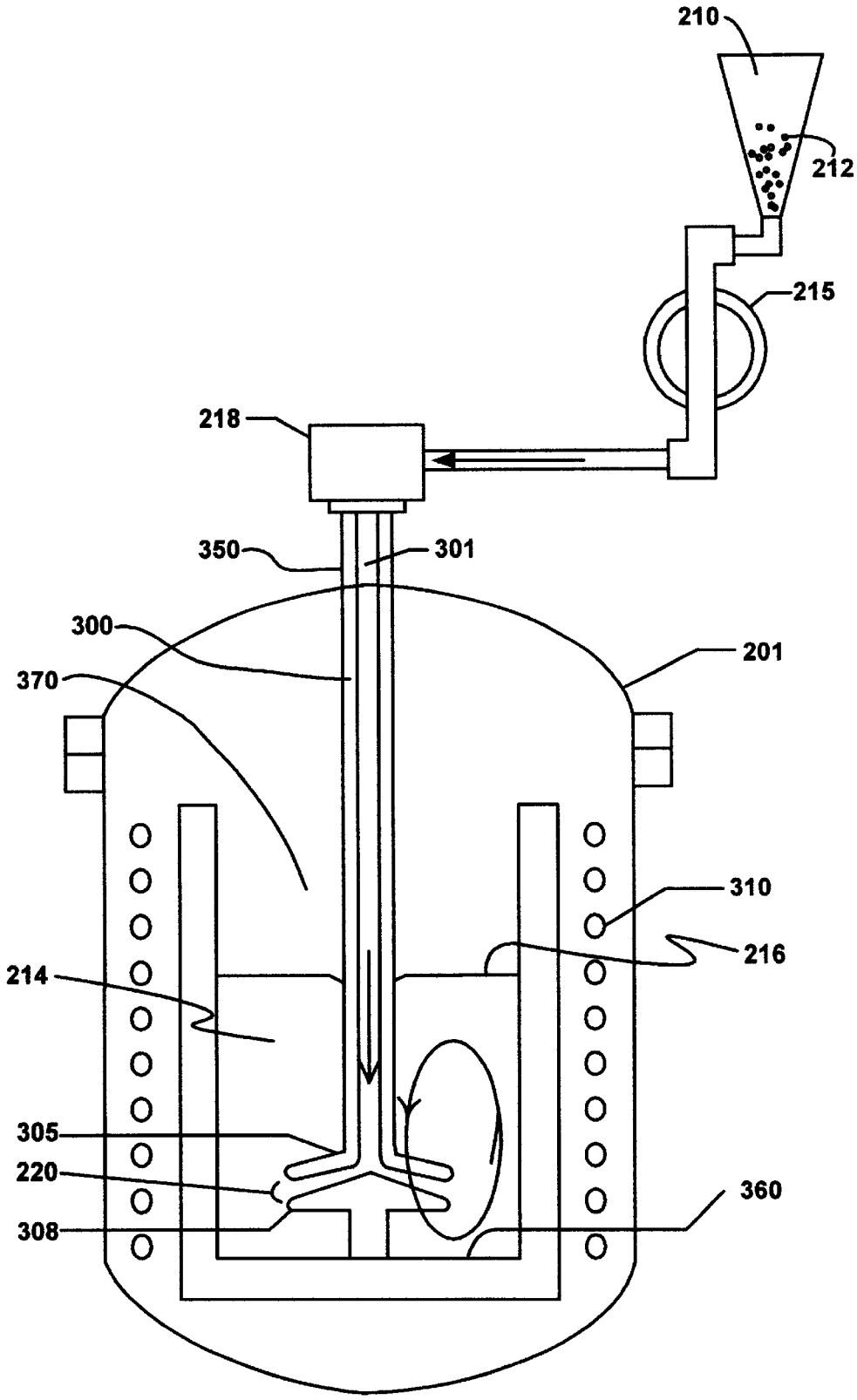
FIG. 2*a* is a schematic side sectional view of a mixing apparatus in accordance with the present invention.

An exemplary embodiment of the present invention for the production of metal matrix composite materials under vacuum is illustrated in FIG. 2*a.* A liquid or semi-liquid medium, such as a metal matrix, is contained within a vacuum vessel 201, which may optionally be heated or cooled.. The vessel has a side wall and a bottom wall and defines a chamber for receiving the medium. One aspect of this embodiment is the design of the impeller 350 which mixes particles into the medium, e.g., a molten metal or metal alloy. The impeller 350 includes a hollow impeller tube 300 having an inner passage 301 into which the particles 212 are directed. The particles 212 are fed through the inner passage 301 and are introduced into the body of the matrix 214 through the lower end of the impeller tube 300 at a point below the matrix surface 216. In this embodiment, the lower end of the impeller tube 300 includes an impeller head 305 which projects radially outward from the impeller tube 300. The shape of the impeller head is not critical and may include, among other shapes, disk-like, conical, and flared horn. The impeller 350 is preferably positioned centrally within the vacuum vessel 201 to maximize agitation during mixing.

It is preferred that the impeller head 305 is made of a ceramic, although other sufficiently durable materials may be used, so long as they are able to withstand the erosive effects from high-speed rotation within a ceramic particle filled composite matrix. Such other materials are well known in the art. Suitable ceramic materials include nitrides, silicides, oxides, and carbides. Particularly preferred ceramics include silicon carbide, aluminum oxide, boron carbide, silicon nitride, and boron nitride.

Preferably, the impeller head 305 is located proximate to (i.e., at or near) the lower or distal end of the impeller tube 300. The radial projection of the impeller head from the impeller tube 300 need not be planar and may be at essentially any angle relative to the longitudinal axis of the impeller tube 300, and may, accordingly, be generally shaped as a disk, a cone or a flared horn. The impeller head 305 may be integral with the impeller tube 300 or may be attached to the impeller tube 300 in any manner such that it rotates when the impeller 350 is rotated. The attachment may be made by way of, for example, a weld, a screw, a bolt, glue, or the like. Rotation of the impeller may be accomplished by any appropriate apparatus such as a motor or the like; in addition, the motor can be placed either internal or external to the vessel, although it is preferable in the case of MMC manufacture that the motor is external to the vessel because of the elevated temperatures within the vessel during MMC processing. The impeller tube 300 may include additional impeller heads or the like along its length to increase the volume of entrained matrix during mixing.

Figure 2B:
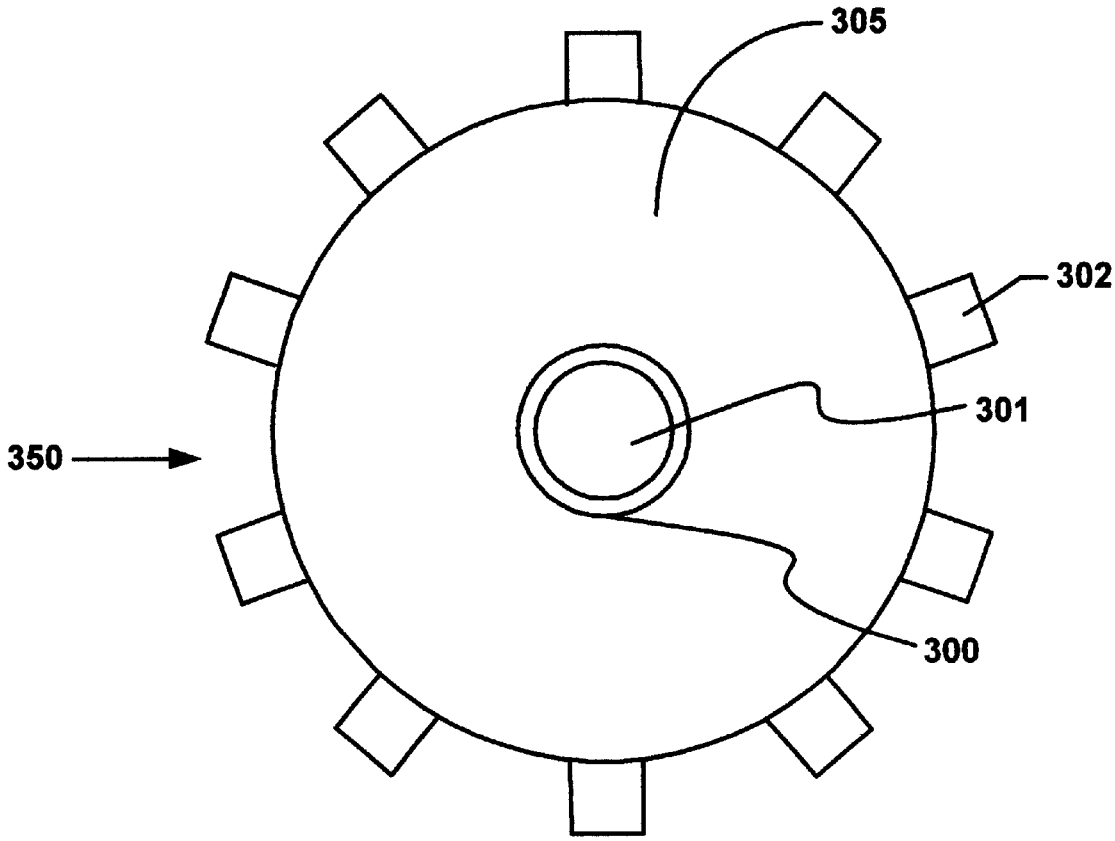
FIG. 2*b* is a top view of the impeller tube and the impeller head of FIG. 2*a;*

Preferably, the impeller head 305 is substantially circular when viewed in plan. It is also preferred that the impeller head 305 comprises one or more teeth 302 proximate to its outer or peripheral edge. Most preferably, the one or more teeth 302 extend radially outward from the peripheral edge of the impeller head 305, as illustrated in FIG. 2*b.* The one or more teeth 302 may be made of any appropriately durable material, again keeping in mind that they should be able to withstand the high erosion incurred by rotation within a matrix containing, for example, ceramic particles. Thus, it is preferred that the one or more teeth 302 are block-shaped and made of a ceramic such as an oxide, a nitride, a silicide, or a carbide. Particularly preferred ceramic materials include silicon carbide, aluminum oxide, boron carbide, silicon nitride, and boron nitride.

Preferably, the impeller head 305 is proximate to (i.e., within a small distance of) an impeller base 308, so as to define in the matrix 214 a shear region 220 in the volume between and around the impeller head 305 and the impeller base 308 when the impeller 350 is rotated. The impeller base 308 may be the inner bottom wall 360, or a portion thereof. Preferably, however, the impeller base 308 comprises a projection positioned above the inner bottom wall 360, as illustrated in FIG. 2*a.* Preferably also, the impeller base 308 comprises one or more teeth to maximize interaction with the impeller head 305 and thereby maximize the shear force. In the embodiment of FIG. 2*a,* the impeller base 308 is attached to and extends upward from the inner bottom wall 360, although the impeller base 308 may extend from, for example, an inner side wall of the vessel 201. Where the impeller base 308 comprises a projection positioned above the inner bottom wall 360, the impeller head 305 is preferably positioned approximately one-third of the distance in the matrix 214 from the inner bottom wall 360 (i.e., two-thirds of the distance from the matrix surface 216); however, the location of the impeller head 305 may be varied within broad limits depending on the vessel geometry, matrix depth, impeller design and impeller base location.

The impeller base 308 is preferably positioned in close proximity and in opposing facing relation to the impeller head 305. Most preferably, the impeller base 308 is stationary for reasons of durability and ease of manufacture. However, with appropriate design modifications, the impeller base 308 may also be rotated during the mixing process. Where the impeller base 308 is rotated by a motor or the like, it is preferred that it is rotated in a direction opposite to that of the impeller in order to maximize the shear force in the shear region. It is preferred that the impeller base 308 is attached to the inner bottom wall 360 and generally aligned with the impeller head 305.

It is preferred that the impeller base 308 is generally shaped and oriented so that its contours are complementary with the contours of the impeller head 305, and is similar in size to the impeller head 305, such as that illustrated in FIG. 2*a.* Thus, if the impeller head 305 is generally in the shape of a concave cone, the impeller base 308 is preferably a convex cone of similar size whose outer contours are substantially parallel to the inner contours of the cone-shaped impeller head 305. By making the impeller base 308 similar in size and shape to the impeller head 305, the size of the shear region 220 is increased so that it exists between and around the volume between the impeller base 308 and the impeller head 305. The shear force generated in the shear region 220 is a function of the distance between the impeller head 305 and the impeller base 308, such that the closer they are to each other, the higher the shear force created between them. One skilled in the art would be able to determine the optimum spacing based on, among other factors, the impeller speed, the matrix viscosity, the size of the particles, and the particle flow rate. In general, the spacing should be as close as possible to maximize the shear force, but far enough to prevent clogging of the shear region with particles or occasional contact of and damage to the impeller base 308 and the impeller head 305 during impeller rotation.

Similarly, in order to increase the shear force in the shear region, the impeller rotational speed should be increased. It is preferred that during the mixing of a MMC the impeller is rotated at a speed achieving at least about 1000 to 2000 surface feet per minute. Such rotational speed is sufficient to provide rapid mixing of particles. The rate of wetting is increased due to the fact that the particles 212 are introduced to the matrix 214 through the shear region 220. Thus, essentially all of the particles 212 fed into the matrix 214 are immediately sheared into the matrix at the point of maximum shear force, and do not have to travel long distances in the matrix before passing through the shear region, as occurs when the particles are added to the matrix surface.

In the embodiment of FIG. 2*a,* ceramic particles 212 are pumped, i.e., mechanically driven under force, by a solids pump 215 from an evacuated (low vacuum: about 0.1–10 torr) particle supply 210 into the inner passage 301 of the impeller tube 300 via a rotating union 218. Preferably, the particles are preheated and dried prior to introduction in order to facilitate flow. The particle supply 210 is preferably a hopper or container or the like, although continuous flow processes may be possible. The design of the apparatus for feeding or pumping the ceramic particles 212 into the impeller tube 300 is not critical to the present invention so long as such feeding or pumping does not require large amounts of carrier gas or the like which could become entrapped within the matrix. Suitable apparatus include, but are not limited to, solids pumps, diaphragms, and rotating unions.

The overall direction of movement in the matrix 214 caused by the rotating impeller and one or more induction coils 310 disposed in the vessel is represented by the vertical ellipse with counter-clockwise pointing arrows in FIG. 2*a.* This movement aids to bring the composite matrix into the vicinity of the impeller for additional passes through or near the shear region 220 and to homogenize the overall composite.

In an alternate but less preferred embodiment (not shown), the particles may be directed through a hollow tube or the like (other than the impeller) such that the particles are introduced into the matrix under the matrix surface at a location proximate to a high shear region. In such an embodiment, the high shear region is preferably created between a rotating impeller and an impeller base in a manner similar to that described above for FIG. 2*a.* The impeller shaft in this embodiment may be either hollow or solid, since the particles are introduced through a separate tube.

Other aspects of the apparatus relating to the production of MMCs in general and to post-production (e.g., casting) are not particularly critical to the present invention. Such aspects would be apparent to one skilled in the art from the present teachings and from the prior art. For example, the process conditions such as, e.g., temperature and vacuum pressure, and the design of various components of the production equipment not specifically described here would be apparent to those skilled in the art. Such process conditions, parameters, and considerations are discussed, for example, in U.S. Pat. No. 5,531,425.

Preferably, the metal or metal alloy used in the present invention comprises aluminum, although other metals such as magnesium may also be used. The particles are preferably made of a metal oxide, a metal nitride, a metal carbide, a metal silicide, or a glass. Although it is preferred that the present invention be used to manufacture stir-cast MMCs wherein the matrix comprises a molten metal and the particles are made of a ceramic, other particle and matrix materials may be usefully employed without departing from the scope of the invention.

Figure 3A:
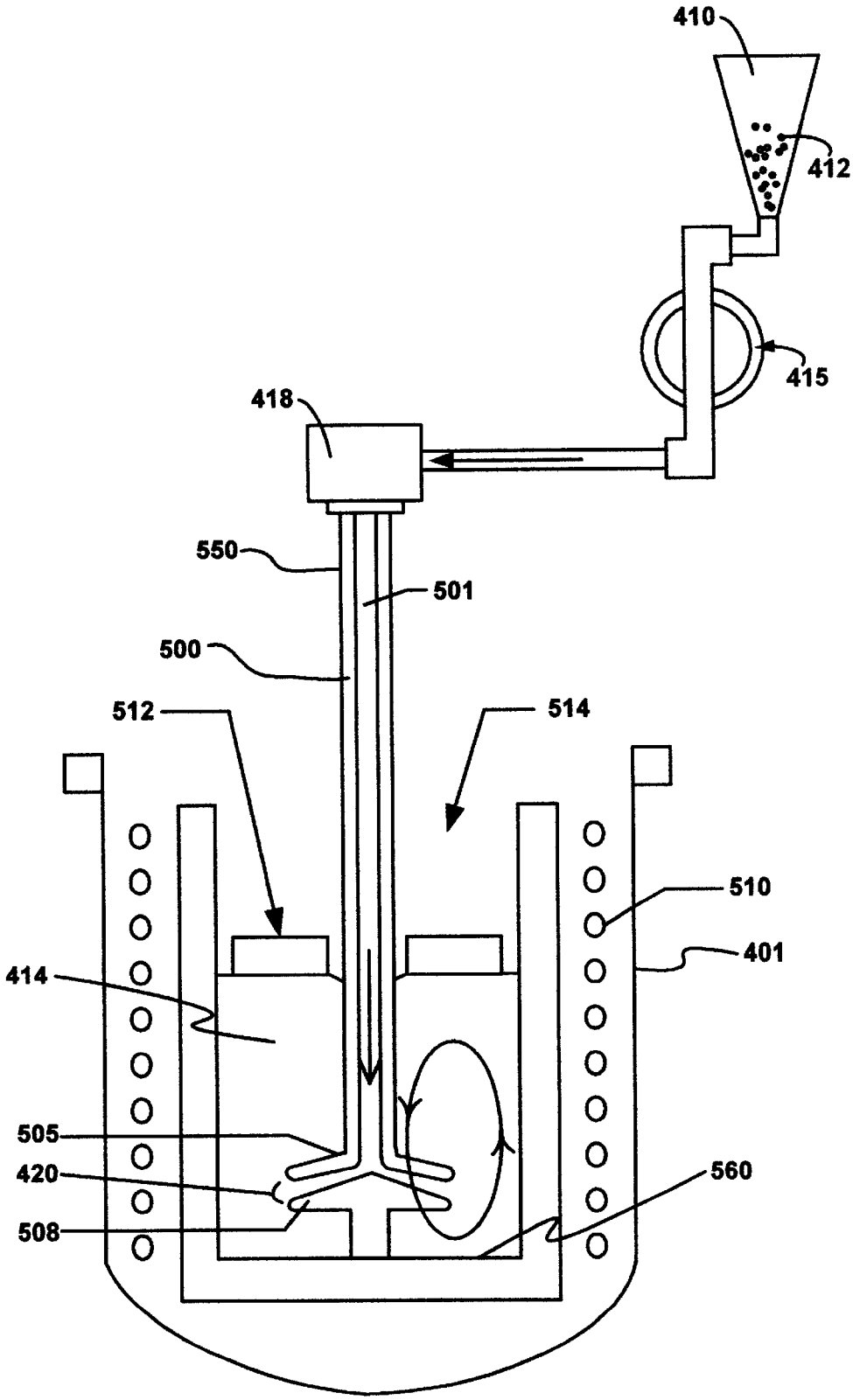
FIG. 3*a* is a schematic side sectional view of another embodiment of a mixing apparatus in accordance with the present invention.

In another exemplary embodiment, shown in FIG. 3, the invention may be practiced in the stir-casting of MMCs under atmospheric pressure, i.e., without the necessity for vacuum. The ability to stir-cast under atmospheric pressure would simplify the process and equipment and ultimately reduce the cost of the end product. The apparatus shown in FIG. 3 is similar to that in FIG. 2*a,* with certain modifications to allow mixing to be performed without a vacuum.

In this embodiment, both the vessel 401 and the particle supply 410 may be kept at atmospheric pressure. Because the process need not be conducted in vacuum, the vessel 401 does not have to be closable or sealable. The matrix surface is preferably covered with a cover 512 to inhibit the formation of a vortex by the rotating impeller 550 and the entrapment of gas and surface oxides in the matrix 414. The cover 512 is preferably made of a low-density ceramic material (e.g., alumina or silica lightweight refractory board), so that it substantially floats on the matrix surface. The formation of a vortex is disadvantageous because the presence of a vortex is known to inhibit particle wetting by incorporating gas into the matrix. optionally, the inner volume of the vessel 401 above the cover 512 may also be filled with a substantially inert gas cover 514 to blanket the matrix surface and inhibit reactions which might occur at the surface of, for example, a molten metal. The particle supply 410 is preferably back-filled with oxygen so that when particles 412 are injected into a molten metal matrix 414, the oxygen is instantly reacted to form an oxide of the metal, thereby eliminating the presence of gases in the composite matrix which could impede the wetting process. For example, if the matrix comprises molten aluminum, the oxygen will react to form aluminum oxide. Thus, particle mixing and wetting should proceed rapidly without any porosity due to gas entrapment.

In other respects, the embodiment of FIG. 3 may resemble closely that of FIG. 2 described above. For example, in the embodiment of FIG. 3, agitation of the matrix is provided by an impeller 550 comprising a hollow impeller tube 500, which is preferably terminated at its lower end by an impeller head 505. A shear region 420 is created between and around the impeller head 505 and a proximate impeller base 508. Additional agitation of the matrix may be supplied by one or more induction coils 510. Particles 412, preferably made of a ceramic, may be pumped into the inner passage 501 of the impeller tube 500 from the particle supply 410 and are introduced to the body of the matrix 414 through the shear region 420 in a manner similar to that described for the embodiment in FIG. 2*a.*

Alternatively, the particle supply 410 may be back-filled with a substantially inert gas such as argon, nitrogen or helium, instead of oxygen. When the particles 412 are injected into the matrix 414, the entrained gas would slowly leave the matrix. In theory, helium gas would exit the matrix most rapidly, but because helium is lighter than air it may be difficult to retain in the particle supply 410 during the. process. Heavier inert gases would probably not exit the melt as easily and could potentially lead to a low level of porosity.

As described above, the present invention provides several embodiments that have a wide range of applications, as scaling of the configurations can be readily accomplished by those skilled in the art. Various modifications and equivalent substitutes may be incorporated into the invention as described above without varying from the spirit of the invention, as will be apparent to those skilled in this technology. For example, while the embodiments specifically disclosed herein are discussed in connection with the mixing of metal matrices, any liquid or semi-liquid medium may be used in accordance with the present invention. Furthermore, the drawings presented herein are intended to illustrate particular embodiments of the present invention and are not intended to act as a limitation on the scope of the following claims.

What is claimed is:

1. An apparatus for mixing ceramic particles into a liquid or semi-liquid medium to form metal matrix composite material, the apparatus comprising:

a vessel having a side wall and a bottom wall and defining a medium receiving chamber, the medium receiving chamber adapted to contain a metal matrix therein;

a rotatable impeller comprising an impeller tube mounted for rotation relative to the vessel, the impeller tube having an inner passage and an impeller head, wherein the impeller head is disposed in the chamber and wherein the impeller head has a non-planar inner contour, the inner contour of the impeller head at a non-orthogonal angle relative to the longitudinal axis of the impeller tube;

an impeller base coupled to and projecting upward from the bottom wall of the vessel such that the impeller base is above the bottom wall, the impeller base proximate to the impeller head, the impeller base having an outer contour facing the inner contour of the impeller head, the outer contour of the impeller base complementary in shape and substantially parallel to the inner contour of the impeller head so as to define a shear region in the metal matrix between the impeller head and the impeller base when the impeller is rotated; and solids pump means coupled to the inner passage for feeding the ceramic particles into the metal matrix within the chamber such that the metal matrix composite material is formed;

whereby the ceramic particles are directed through the inner passage and into the metal matrix through the shear region such that the ceramic particles are immediately sheared into the metal matrix at a point of maximum shear force.

2. The apparatus of claim 1, wherein the impeller head comprises one or more teeth.

3. The apparatus of claim 2, wherein the one or more teeth are made of a ceramic material selected from the group consisting of nitrides, silicides, oxides, and carbides.

4. The apparatus of claim 1, wherein the impeller base is stationary.

5. The apparatus of claim 1, wherein the vessel comprises one or more induction coils.

* * * * *